United States Patent [19]

Penning

[11] 3,944,759

[45] Mar. 16, 1976

[54] MICROPHONE PROVIDED WITH A CYLINDRICALLY SHAPED MICROPHONE CARTRIDGE

[75] Inventor: Cornelis Penning, Eindhoven, Netherlands

[73] Assignee: U.S. Philips Corporation, New York, N.Y.

[22] Filed: Nov. 27, 1973

[21] Appl. No.: 419,431

[30] Foreign Application Priority Data

Dec. 6, 1972 Netherlands ..... 7216501

[52] U.S. Cl. ..... 179/184; 179/179; 179/111 E

[51] Int. Cl.[2] ..... H04R 1/02

[58] Field of Search ..... 179/111 E, 111 R, 106, 179/179, 181 R, 146 R, 178, 180, 184; 307/88 ET

[56] References Cited

UNITED STATES PATENTS

| | | | |
|---|---|---|---|
| 2,567,889 | 9/1951 | Moreland, Jr. | 179/181 R |
| 3,108,162 | 10/1963 | Schindler | 179/111 R |
| 3,174,129 | 3/1965 | Laughlin | 179/179 |
| 3,436,495 | 4/1969 | Gorike | 179/146 |
| 3,624,312 | 11/1971 | Koukal et al. | 179/111 E |
| 3,651,286 | 3/1972 | Gorike et al. | 179/180 |
| 3,816,671 | 6/1974 | Fraim et al. | 179/111 E |

*Primary Examiner*—Kathleen H. Claffy
*Assistant Examiner*—Joseph Popek
*Attorney, Agent, or Firm*—Frank R. Trifari; Bernard Franzblau

[57] ABSTRACT

A microphone provided with a suspension diaphragm which serves to support a freely suspended microphone cartridge, preferably of the electret type, the suspension diaphragm being substantially coplanar with the acoustic diaphragm of the microphone cartridge. At least one groove entirely closes acoustically the air-gap surrounding the freely suspended microphone cartridge. The groove is further provided with lug-shaped flanges, one for clamping the microphone cartridge and the other for suspension from a frame, mount or microphone case. The suspension diaphragm is particularly suitable for light-weight microphone cartridges.

16 Claims, 9 Drawing Figures

MICROPHONE PROVIDED WITH A CYLINDRICALLY SHAPED MICROPHONE CARTRIDGE

Figure 1:
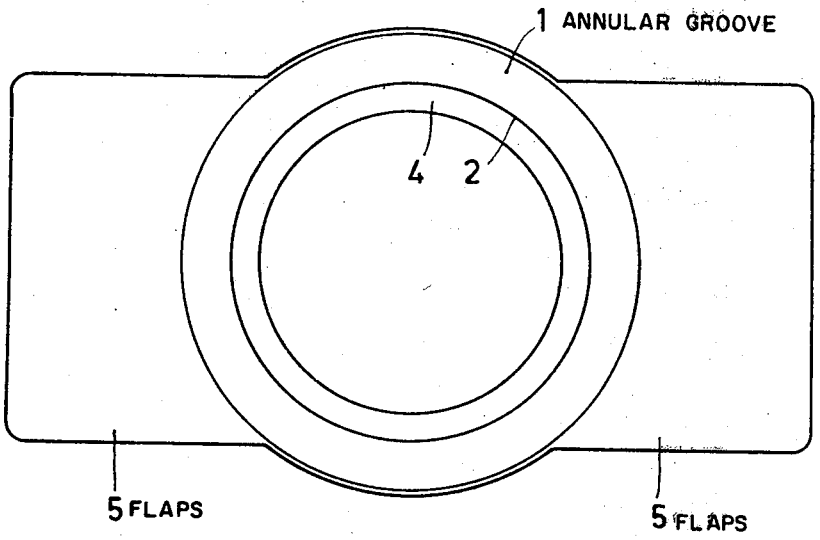

In the last few years microphones have extensively been miniaturized. The slimness of rod-shaped microphones is progressively increasing.

Also small-size cassette tape recorders including built-in microphones are commercially available. These microphones, which may be detachable, are allotted very little space.

Microphones particularly suitable for this purpose are of the capacitor microphone type and especially of the type provided with an electret diaphragm. The diaphragm usually is secured in an annular mount which also encloses the back electrode shape in the form of pastille. Since this construction is very simple and the cross-sectional area of the diaphragm need only be small to provide the required energy output, the size of the microphone cartridge may be very small and its height may even be smaller than its diameter.

The incorporation of electronic circuits in integrated-circuit form substantially does not affect either the size or the weight of the microphone cartridge.

Thus what are referred to as light-weight electret microphone cartridges are commercially available which have a weight of 3 grams and a diameter of 12 mm. Specifically for these light-weight cartridges a vibration-free suspension in the microphone casing or holder forming part of a cassette tape recorder is of particular importance and hence another method of suspension must be used than has been usual hitherto with heavier microphone cartridges.

The invention relates to a microphone provided with a cylindrically shaped microphone cartridge which is centrally suspended in a microphone casing by means of at least one resilient suspending diaphragm so as to form an annular air-gap with the casing.

The term "microphone casing" is to be understood to include a mount as used in a cassette tape recorder.

Such a microphone is described in U.S. Pat. No. 3,436,495. In this microphone the cartridge is provided on either side with a pin secured centrally in a suspension diaphragm. The microphone cartridge is rod-shaped and includes an electrodynamic microphone system behind which a microphone amplifier is built in in the cartridge. The weight of the assembly is heavy and its construction is complicated.

The invention is characterized in that a single suspension diaphragm carries a light-weight microphone cartridge the acoustic diaphragm of which is substantially coplanar with the suspension diaphragm. A large number of tests have shown that the coplanarity of the two diaphragms provides optimum protection against the influence of external vibrations (generally referred to as case noise) on the acoustic diaphragm.

Thus vibration-free suspensions are achieved in which the resonant frequency of the suspending system is less than 100 Hz.

At the location of the air-gap the suspending diaphragm may comprise at least one groove which entirely closes the air-gap acoustically. This closure is required to avoid the occurrence of inconvenient peaks of the frequency characteristic in the region exceeding 2000 Hz.

The inner edge of the groove may be used for clamping and securing the microphone cartridge. For this purpose the inner edge of the groove is strengthened by the provision of a lug-shaped flange which is bent about the edge of the cartridge and together with the inner edge of the groove is glued to the catridge.

The suspension diaphragm must be provided with a supporting edge which also may have a bent lug.

A particularly satisfactory suspension diaphragm is provided with two opposed flaps. The flaps may be rectangular and be supported in matching recesses in the microphone case.

To provide a satisfactory vibration-free suspension the material of the suspension diaphragm must have high internal damping. In this respect butyl rubber and polyvinylchloride (pvc) are highly suitable.

Alternatively the suspension diaphragm may be made of polycarbonate foil. However, because the internal damping of this material is small, in spite of the fact that the resonant frequency is less than 50 Hz, the influence of the case noise is comparatively large.

In a particularly advantageous embodiment the inner rim of the groove has a cylindrical part which engages around the microphone cartridge. If in this embodiment butyl rubber is used the suspension of the microphone cartridge is very soft.

Figure 2:
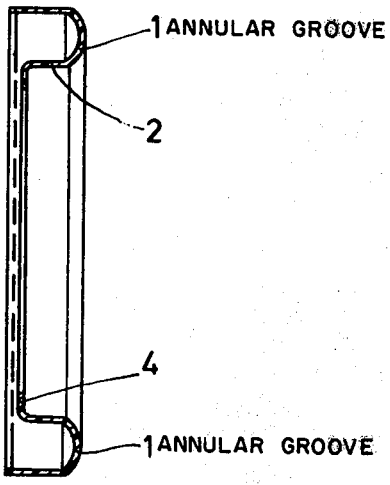
Figure 3:
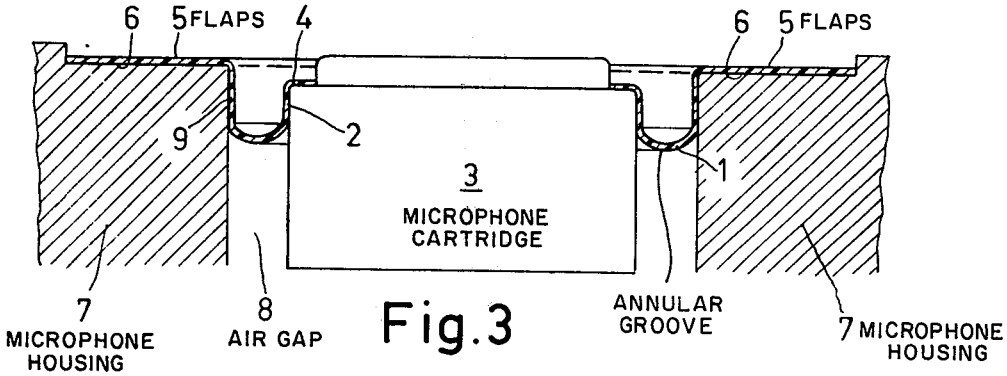

Embodiments of the invention will now be described, by way of example, with reference to the accompanying diagrammatic drawings, in which:

FIGS. 1 to 3 show a suspension diaphragm according to the invention,

FIG. 1 being a plan view and

FIG. 2 being a cross-sectional view, while

FIG. 3 is a longitudinal sectional view including the microphone cartridge.

Figure 4:
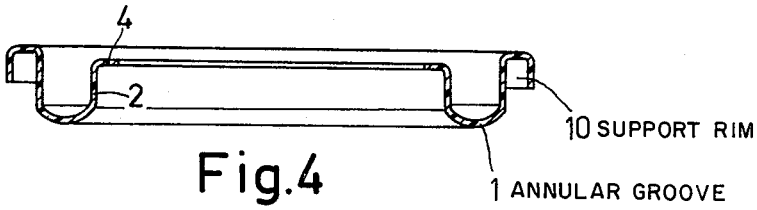
Figure 5:
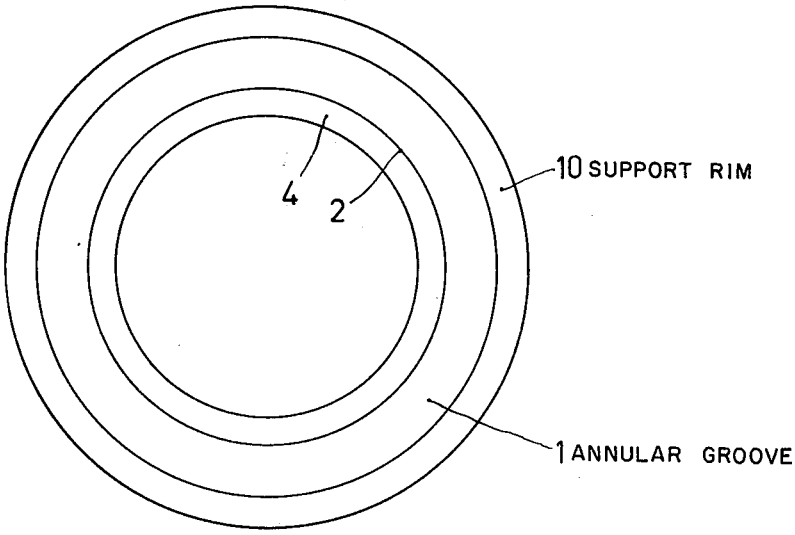
Figure 6:
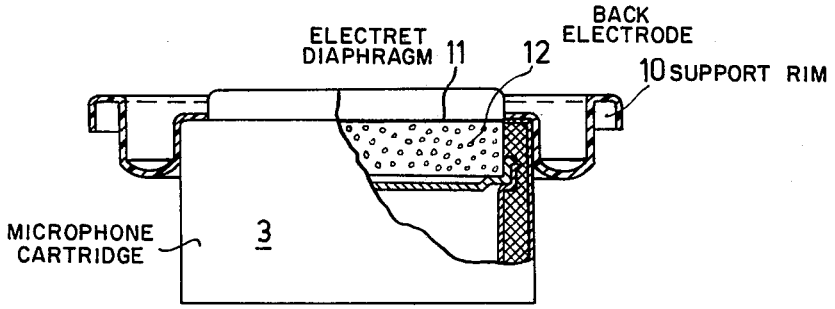
Figure 7:
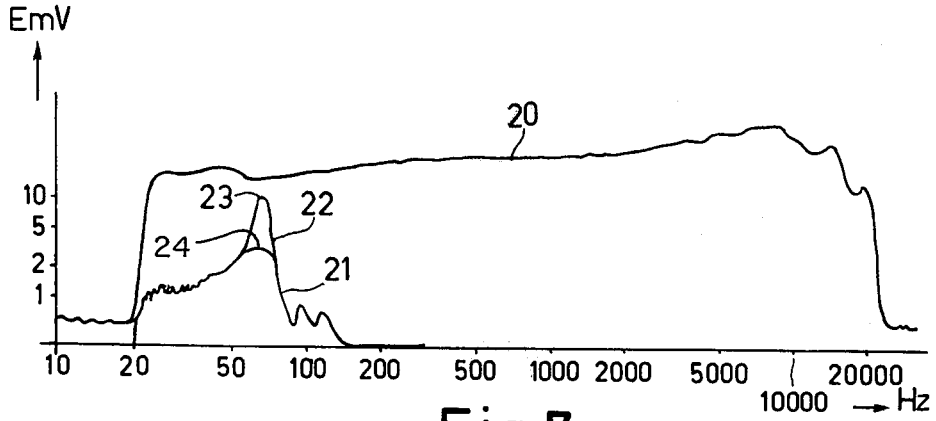
Figure 8:
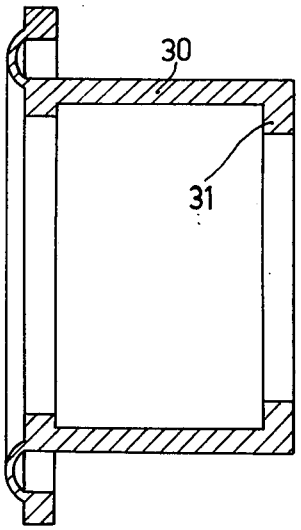
Figure 9:
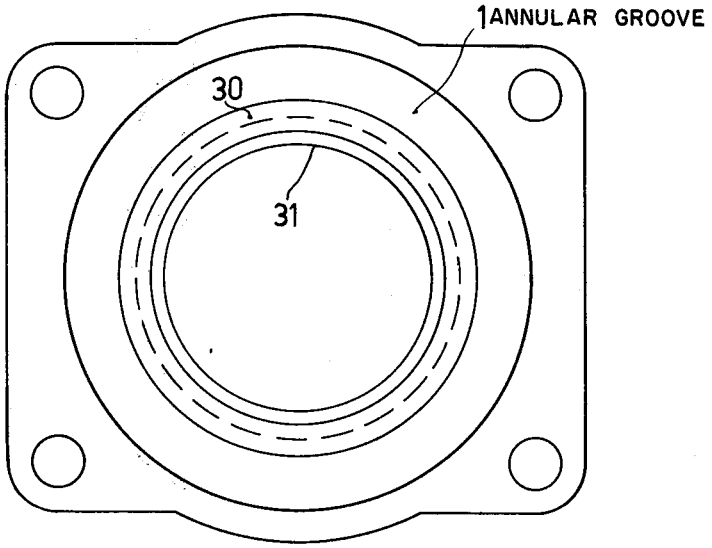

FIGS. 4 to 6 show an embodiment of the suspension diaphragm shown in FIG. 1, FIG. 4 being a longitudinal sectional view and FIG. 5 being a plan view, while FIG. 6 is a longitudinal sectional view including a microphone cartridge which is partly cut away, FIG. 7 shows frequency characteristics and FIGS. 8 and 9 show a butyl rubber suspension according to the invention, FIG. 8 being a cross-sectional view and FIG. 9 a plan view.

The suspension diaphragm shown in FIGS. 1 to 3 is made of polycarbonate and is formed with a single annular groove 1. The inner surface 2 serves to receive a microphone cartridge 3. The suspension diaphragm is slipped onto the microphone cartridge. The inner surface 2 of the suspension diaphragm is dimensioned so that the cartridge is clamped in the diaphragm.

The inner surface 2 is formed with a lug-shaped flange 4 which engages around the microphone cartridge 3.

The microphone cartridge 3 is glued to the inner surface 2 and to the flange 4.

The suspension diaphragm is provided at two opposed locations with flaps 5 which lie within recesses 6 in a frame 7. The width of the groove 1 is equal to that of an air-gap 8 between the cartridge 3 and the frame 7. The frame 7 is shown schematically in FIG. 3 and forms part of a microphone case. The outer surface 9 of the groove 1 is concentric with the inner surface 2. The suspension diaphragm is secured to the frame 7 by suction and/or clamping force.

FIGS. 4 to 6 show a modified embodiment of the suspension diaphragm shown in FIGS. 1 to 3. The flaps 5 are replaced by a lug-shaped supporting rim 10 which engages around a frame, not shown.

FIG. 6 shows a partly cut-away microphone cartridge 3. This cartridge is of the electrostatic type and includes an electret diaphragm as the acoustic diaphragm 11 which is supported by a back electrode 12 made of a sintered ceramic material. The surface of the electret diaphragm 11 more remote from the sintered electrode 12 carries an electrode in the form of a layer of gold deposited from vapour and a few $\mu$m thick. The thickness of the electret foil is 20 $\mu$m. FIG. 6 shows that the acoustic diaphragm 11 is substantially coplanar with the suspension diaphragm.

In FIG. 7 curve 20 is the frequency characteristic of the electret microphone cartridge used, without the suspension. The frequency in Hz is plotted along the horizontal axis and the output voltage E of the cartridge in millivolts is plotted along the vertical axis.

The characteristic of the suspension is shown by a second curve 21. It has a resonance peak 22 at about 70 Hz, which is lower than the required standard (which is 100 Hz).

The curve 21 also shows the difference between various materials. When using a material of low internal damping, in the present case polycarbonate, the resonance peak is higher and lies at about 10 millivolts (designated by 23).

When using butyl rubber, i.e. a material of high internal damping, the resonance peak is considerably lower and lies at about 2.5 millivolts (designated by 24).

When flaps 5 are used the resonant frequency is shifted slightly to the left, i.e. the resonant frequency is lower.

The frequency characteristics of FIG. 7 relate to the suspension diaphragm shown in FIGS. 4 to 6.

This suspension diaphragm is made of polycarbonate or of butyl rubber and has the following dimensions:

| | |
|---|---|
| thickness | 40 $\mu$m |
| internal diameter | 10.5 mm |
| outer diameter | 15.9 mm |
| width of the groove | 1.9 mm |
| height of the groove | 2.0 mm |
| mass of the cartridge | 3 grams. |

To enable the gluing of the cartridge to be dispensed with the suspension diaphragm shown in FIGS. 8 and 9 has a cylindrical portion 30 which terminates in an inner flange 31 and is of a size such as to embrace the entire microphone cartridge.

The material of this suspension diaphragm is very flexible and may for example be butyl rubber or silicone rubber.

What is claimed is:

1. A microphone assembly comprising a microphone case, a cylindrically shaped lightweight microphone cartridge including a generally planar acoustic vibratory diaphragm, a single resilient generally planar suspension diaphragm fixed to the case and supporting the microphone cartridge centrally within the microphone case so that case and cartridge form an annular air gap, the acoustic diaphragm of the cartridge being substantially coplanar with the suspension diaphragm.

2. A microphone assembly as claimed in claim 1 wherein the suspension diaphragm is formed with at least one groove which entirely closes the air-gap acoustically.

3. A microphone assembly as claimed in claim 2, characterized in that the cartridge is clamped in the inner edge of said groove.

4. A microphone assembly as claimed in claim 3 wherein the inner edge of the groove is provided with a lug-shaped flange which is bent around the microphone cartridge to further clamp the cartridge in place.

5. A microphone assembly as claimed in claim 2 wherein the suspension diaphragm is provided with a supporting flange outside the air-gap for fixing the suspension diaphragm to the microphone case.

6. A microphone as claimed in claim 5, wherein the supporting flange is formed with a bent lug.

7. A microphone assembly as claimed in claim 5, wherein the supporting flange is provided with two opposed flaps.

8. A microphone assembly as claimed in claim 1 wherein the suspension diaphragm is made of a material of high internal damping.

9. A microphone assembly as claimed in claim 3 wherein the inner edge of the groove terminates in a cylindrical part which entirely engages around the microphone cartridge.

10. A microphone assembly as claimed in claim 1 wherein the microphone cartridge includes an electret diaphragm having a diameter of at least 5 mm but less than 20 mm, the mass of the cartridge being less than 10 grams.

11. An electroacoustic transducer assembly comprising a transducer cartridge housing a substantially planar acoustic vibratory diaphragm, a housing for said transducer cartridge, a single suspension diaphragm having a peripheral portion that is fixed to said housing and a generally planar inner portion including means for supporting the transducer cartridge centrally within the housing so as to form a peripheral air gap between the cartridge and housing, the single suspension diaphragm being the sole support of the transducer cartridge within the housing and with the acoustic diaphragm of the cartridge being supported substantially coplanar with the planar portion of the suspension diaphragm.

12. A transducer assembly as claimed in claim 11 wherein said cartridge is cylindrically shaped to form an annular air gap with the housing and the suspension diaphragm comprises a resilient vibration - absorbing member.

13. A transducer assembly as claimed in claim 12 wherein the generally planar portion of the suspension diaphragm is formed with an annular groove located so as to acoustically close said annular air gap.

14. A transducer assembly as claimed in claim 13 wherein the generally planar portion of the suspension diaphragm includes an annular lip bearing against one end portion of the cartridge and the inner surface of the groove clamps a portion of the side wall of the cartridge to provide support therefor.

15. A transducer assembly as claimed in claim 13 wherein the suspension diaphragm is made of a material having high internal damping.

16. A transducer assembly as claimed in claim 11 wherein the material of the suspension diaphragm is selected from the group of materials consisting of butyl rubber and polyvinylchloride.

* * * * *